United States Patent [19]

Kochevar

[11] Patent Number: 4,496,153

[45] Date of Patent: Jan. 29, 1985

[54] METHOD OF WEIGHTING AN ARTICLE

[76] Inventor: Rudolph J. Kochevar, 252 Arbolada Dr., Arcadia, Calif. 91006

[21] Appl. No.: 569,583

[22] Filed: Jan. 10, 1984

[51] Int. Cl.[3] ..... A63B 53/02

[52] U.S. Cl. ..... 273/80.8; 273/169

[58] Field of Search ..... 273/80.8, 169, 80.2–80.7, 273/162 R, 162 B, 170, 171, 81 A, 80 B

[56] References Cited

U.S. PATENT DOCUMENTS

| | | | |
|---|---|---|---|
| 1,889,743 | 12/1932 | Buhrke et al. | 273/80.6 |
| 1,895,417 | 1/1933 | Lard | 273/80.8 X |
| 1,940,168 | 12/1933 | Hillerich | 273/80.6 |
| 3,191,936 | 6/1965 | Guir | 273/80.2 |
| 3,410,558 | 12/1968 | Reuter, Jr. | 273/80.2 |
| 3,429,576 | 2/1969 | Ikeda | 273/162 B |
| 3,625,513 | 12/1971 | Ballmer | 273/80.5 |
| 3,638,347 | 2/1972 | Kochevar | 43/42.39 |
| 3,762,707 | 10/1973 | Santorelli | 273/80 B |
| 3,782,025 | 1/1974 | Kochevar | 43/44.9 |
| 4,220,336 | 9/1980 | Kochevar | 273/80.8 |
| 4,452,456 | 6/1984 | Kochevar | 273/80.8 X |

*Primary Examiner*—William H. Grieb

*Attorney, Agent, or Firm*—Gordon L. Peterson

[57] ABSTRACT

A method of making a weighted article comprising providing a member having a cavity with an anchor affixed to the member, placing a mass of permanently deformable weight composition into the cavity and deforming the mass of weight composition to embed the anchor in the weight composition and to cause the weight composition to circumscribe at least a region of the anchor to securely lock the weight composition in the cavity.

20 Claims, 8 Drawing Figures

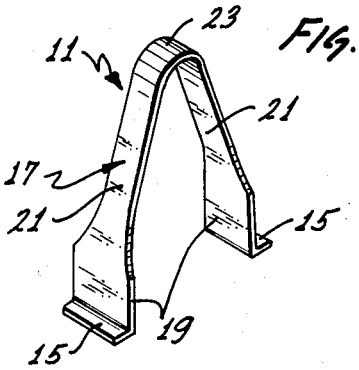
FIG. 1
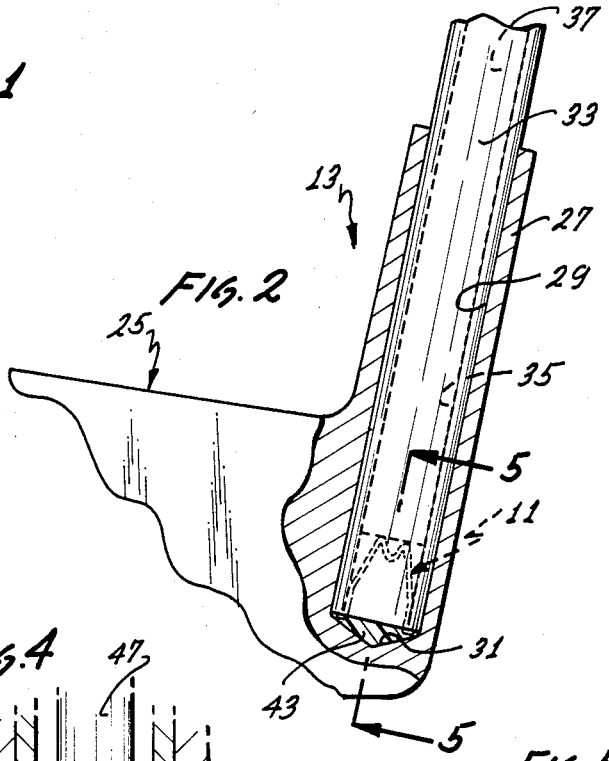
FIG. 2
FIG. 3
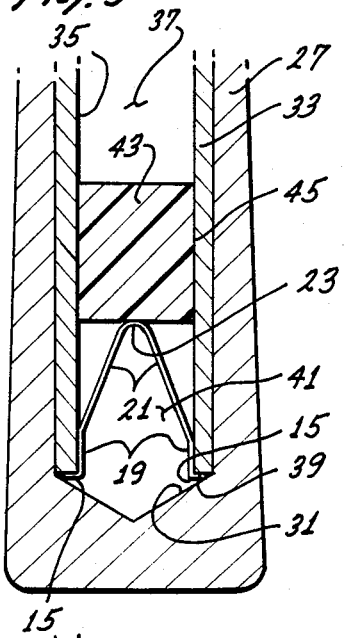
FIG. 4
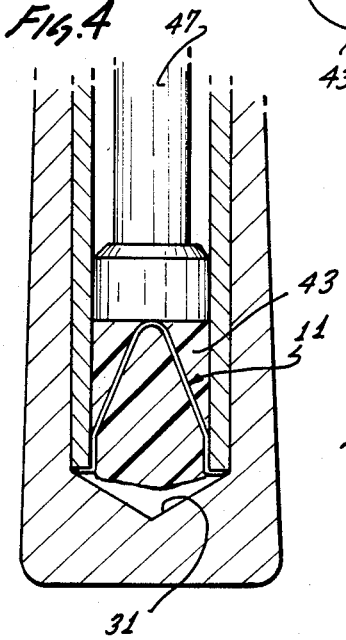
FIG. 5
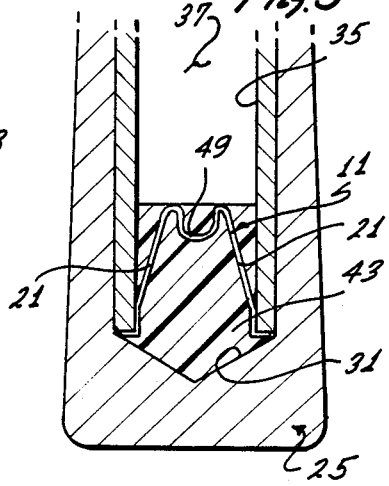
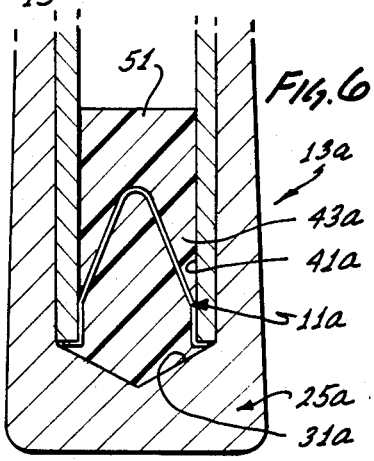
FIG. 6
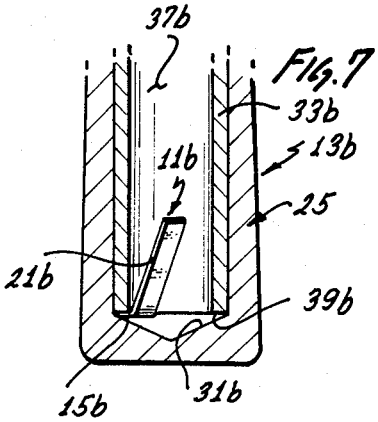
FIG. 7
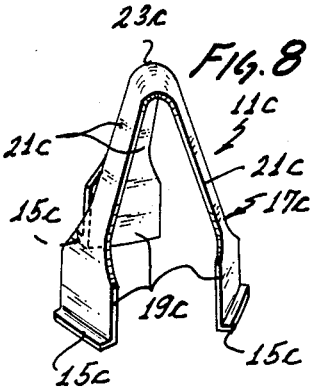
FIG. 8

METHOD OF WEIGHTING AN ARTICLE

BACKGROUND OF THE INVENTION

Various manufacturing, maintenance and repair jobs call for internally weighting a member. For example, in the manufacture of golf clubs, it is necessary to accurately weight each club in order to provide a matched set of clubs.

A golf club typically includes a head having a tubular section and a tubular shaft. One end of the tubular shaft is received within the tubular section of the head and suitably affixed thereto. With this construction, a cavity is defined by the internal surfaces of the tubular shaft and the tubular section of the head. In order to weight the club, it is conventional practice to place a weight into the end of the tubular shaft remote from the head and allow such weight to travel through the passage in the shaft. The weight is then secured in place at or near the bottom of the passage.

My U.S. Pat. No. 4,220,336 discloses a method of weighting articles, such as golf clubs, with a mass of permanently deformable weight composition. The weight composition, which may be in capsule form, is placed in the cavity of the golf club and compressively loaded to extrude the mass of weight composition into intimate contact with the wall of the cavity. Golf clubs inherently have a small, radially thin shoulder in the cavity and the weight capsule can be extruded into contact with the shoulder to help retain the capsule within the cavity. In addition, the weight composition has an adherent quality which tends to stick it to the wall of the cavity.

The method disclosed in my prior patent functions very satisfactorily for many applications. However, the tubular shafts are often rusty and dirty, and the weight composition must be passed through the rusty shaft into the cavity. Because the weight composition is somewhat adherent, the rust and dirt readily stick to it, and to that extent, reduce its ability to adhere to the wall of the cavity. In this event, the relatively small shoulder in the cavity may be unable to adequately retain the weight composition in position. As a consequence, the weight may rattle during use, and this may cause the golf club to be rejected or returned to the factory.

SUMMARY OF THE INVENTION

This invention is an improvement on the invention disclosed in my prior U.S. Pat. No. 4,220, 336. To improve the tendency of the weight composition to remain in the cavity and not rattle, this invention provides an anchor which is affixed within the cavity and extends within the cavity at least part way across the cavity. The mass of weight composition can then be deformed to substantially embed the anchor in the weight composition. The weight composition substantially circumscribes at least a region of the anchor to securely interlock the mass of weight composition and the anchor to firmly retain the weight composition in the cavity.

Unlike the shoulder of my prior patented construction, the anchor has a portion which is substantially circumscribed by the mass of weight composition. This grabbing of the anchor by the mass of weight composition greatly improves the retention of the mass of weight composition.

Although this invention is particularly adapted to the weighting of a golf club, it is more generally applicable to the weighting of many different articles having a cavity for receiving the weight. In an article such as this, the anchor is affixed to the member and extends within the cavity at least part way across the cavity. A mass of permanently deformable weight composition is placed into the cavity and such mass is deformed to embed at least a portion of the anchor in the mass of weight composition. The mass of weight composition substantially circumscribes at least a region of the anchor to interlock the mass and the anchor.

Although the anchor can be of various different constructions, to improve its ability to retain the mass of weight composition, it preferably has relatively broad surfaces which are exposed within the cavity. Preferably, the anchor includes a relatively flat band extending at least part way across the passage with the band being embedded in the mass of weight composition in the weighted article.

To maximize the exposure of the anchor to the weight composition, the anchor preferably extends a significant distance into the cavity. In a preferred construction, the anchor extends across the cavity from one location on its periphery to another location on its periphery. To further increase the surface area of the anchor exposed in the cavity, the anchor may extend both axially and radially within the cavity.

The anchor may be retained within the cavity in various different ways. In a preferred construction, the anchor includes at least one flange which is clamped in the cavity. In the case of a golf club, the flange is preferably clamped between the head and the tubular shaft.

The retention powers of the anchor may be further improved by making the anchor deformable and deforming the anchor in the mass of weight composition. This provides surfaces of irregular configuration which can grip, and be gripped by, the mass of weight composition.

The invention, together with additional features and advantages thereof may best be understood by reference to the following description taken in connection with the accompanying illustrative drawing.

BRIEF DESCRIPTION OF THE DRAWING

FIG. 1 is an isometric view of one form of anchor constructed in accordance with the teachings of this invention.

FIG. 2 is an elevational view partially in section of a golf club which has been weighted in accordance with this invention.

FIGS. 3–5 are enlarged fragmentary sectional views taken generally along line 5—5 showing the method of this invention.

FIG. 6 is a view similar to FIG. 5 showing a second embodiment of the invention.

FIG. 7 is a view similar to FIG. 3 illustrating a second form of anchor retained in a cavity in a golf club.

FIG. 8 is an isometric view of a third form of anchor.

DESCRIPTION OF THE PREFERRED EMBODIMENTS

FIG. 1 shows an anchor 11 which is particularly adapted for use with a golf club 13 (FIG. 2). Although the anchor 11 can be of various different constructions, in the form shown in FIG. 1, it includes two flanges or flange sections 15 integrally joined by a band 17. The anchor 11 is deformable and is preferably integrally constructed from a single piece of relatively thin guage metal. The band 17 has inner and outer flat surfaces, and the band generally forms an inverted V. More specifically, the band 17 is symmetrical and has axial sections 19 joined to the flanges 15, respectively, inclined sections 21 and a joining section 23 integrally joining the inclined sections 21. As shown in FIG. 1, the width of the axial sections 19 and the associated flanges 15 is greater than the width of the sections 21, and the width of the band 17 increases adjacent the axial sections.

Golf club 13, which may be a wood or an iron, includes a head 25 (FIG. 2) having an integral tubular section 27 extending upwardly from the head. The tubular section 27 has an internal bore or passage 29 extending from the upper end of the tubular section 27 downwardly to terminate in end wall 31 in the head 25.

The club 13 also includes a tubular shaft or shank 33 (FIGS. 2 and 3) having an inner surface 35 defining an axial passage 37 extending completely through the shaft. The shaft 33 is received in the passage 29 with a lower end face 39 of the shaft 33 being closely adjacent the end wall 31. The shaft 33 is suitably attached to the head 25 as by an adhesive. With this construction, the end wall 31, the lower portion of the inner surface 35, the end face 39, and if desired, a portion of the peripheral surface of the passage 29 define a cavity 41 (FIG. 3), and the cavity 41 may be considered as being in the passage 29 of the tubular section 27.

To weight the golf club 13, the anchor 11 is affixed to the golf club within the cavity 41. Although this can be accomplished in different ways, in the embodiment illustrated, the flanges 15 are clamped between the lower end face 39 and the bottom wall 31 as shown in FIG. 3. In addition thereto, or in lieu thereof, an adhesive may be used to affix the flanges 15 to the end wall 31 and the end face 39, and if desired, adhesive may also be used to attach the axial sections 19 to the inner surface 35. When attached in this fashion, the anchor 11 extends diametrically across the cavity 41 from one location on the periphery of the the cavity to another location on the periphery of the cavity. The anchor 11 is attached to the golf club 13 adjacent the end wall 31 and projects away from the end wall. The inclined sections 21 project radially inwardly and axially away from the end wall 31.

To weight the club 13, a mass or body 43 of permanently deformable, somewhat adherent weight composition is placed into the passage 37 at its upper end (not shown) and allowed to fall by gravity to the position shown in FIG. 3 in which it engages the joining section 23 of the band 17. The mass 43 is of the appropriate weight to bring the golf club 13 to the desired weight. The weight composition may be of the type disclosed in my U.S. Pat. No. 4,220,336. The mass 43 of weight composition is easily manually moldable and is preferably of putty-like consistency. This makes the weight composition easily extrudable or deformable into the shape of the cavity in which it is placed. The putty-like consistency also permits fine weight adjustments to be made by manually pinching off or manually adding portions of the weight composition. The weight composition includes heavy particulate material, such as powdered metal, and a binder, which preferably has an adherent or sticky quality. For example, the weight composition may comprise 90 percent by weight of powdered lead (80 to 325 mesh) and a binder comprising 6 percent by weight of polyisobutylene and 4 percent by weight of beeswax.

Rust, dirt, and other contaminants typically line the inner surface 35. In falling through nearly the full length of the passage 37, some of the rust, dirt and contaminants stick to the relatively adherent periphery of the weight composition. Consequently, the mass 43 has a peripheral wall 45 which is relatively dirty, and therefore less adherent.

Next, a ram 47 (FIG. 4) is extended into the shaft from above as shown in FIG. 4 to axially compressively load the mass 43 and force it downwardly over the anchor 11. Although the ram 47 may move downwardly essentially continuously, in a first stage of such movement, the mass 43 is forced over the anchor 11 somewhat as shown in FIG. 4. Preferably the anchor 11 is sufficiently stiff so that it undergoes essentially no permanent deformation as a result of this first stage of advancing movement of the ram 47. In the second and final stage of advancing movement of the ram 47 toward the end wall 31, the mass 43 and the anchor 11 are deformed and this buckles and deforms the anchor 11 to form a deformed buckled region 49 (FIG. 5). The mass 43 of weight composition is deformed against the bottom wall 31 and takes the shape of the cavity 41. In this condition, the anchor is embedded in the mass 43 of weight composition and the mass fully circumscribes and grips a major region of the anchor including the inclined sections 21 and the deformed region 49.

The mass 43 is securely and firmly retained in the position of FIG. 5 as a result of the gripping by the mass 43 of weight composition of a substantial region of the anchor 11. In addition, the adherent quality of the mass 43, although diminished at the peripheral wall 45, is undiminished in its interior. Accordingly, the interior of the mass 43 with its full adherent strength can adhere to the broad surfaces of the anchor 11 which it engages.

FIG. 6 shows a golf club **13*a* which is identical to the golf club 13 in all respects not shown or described herein and illustrates the adaptability of the anchor 11 to masses 43 of varying sizes. Portions of the golf club 13*a* corresponding to portions of the golf club 13 are designated by corresponding reference numerals followed by the letter a. The only difference between the golf clubs 13 and 13*a* is that with the latter a larger mass 43*a* of weight composition is utilized so that when the weight composition is fully deformed into the cavity 41*a* and against the end wall 31*a*, there is a layer 51 of the weight composition above the anchor 11*a*. Consequently, the anchor 11*a* is not materially permanently deformed like the anchor 11 of FIGS. 1**–

FIG. 7 shows a golf club **13*b* which is about to be weighted and which is identical to the golf club 13 in all respects not shown or described herein. Portions of the golf club 13*b* corresponding to portions of the golf club 13** are designated by corresponding reference numerals followed by the letter b.

The only difference between the golf clubs 13 and **13*b* is in the configuration of the anchor 11*b*. The anchor 11*b* comprises a flange 15*b* which is clamped between the end wall 31*b* and the lower end face 39*b* of the tubular shaft 33*b* and one inclined section 21*b* which projects upwardly away from the bottom wall 31*b* and radially inwardly as it extends away from the flange 15*b*. The inclined section 21*b* has broad flat faces and forms a band which extends over half way across the passage 37*b*. The anchor 11*b* is deformable and constructed of metal. Because the anchor 11*b* is, in effect, cantilevered from the flange 15*b*, it must be made heavier to have the same stiffness as the anchor 11** against axial deformation.

FIG. 8 shows an anchor 11*c* which is essentially identical to anchor 11 except that it includes a band 17*c* with three axial sections 19*c* and three inclined sections 21*c*, and there are three flanges 15*c*. In addition, the adjoining section 23*c* integrally joins the three inclined sections 21*c*. The inclined sections 21*c* are equally spaced circumferentially.

Although an exemplary embodiment of the invention has been shown and described, many changes, modifications and substitutions may be made by one having ordinary skill in the art without necessarily departing from the spirit and scope of this invention.

I claim:

1. A method of making a weighted article comprising:

providing a member having a cavity with an anchor affixed to said member and extending within the cavity at least part way across the cavity;

placing a mass of permanently deformable weight composition into the cavity with such mass being sufficient to give the member approximately the desired weight; and deforming the mass of weight composition in the cavity to substantially embed at least a portion of the anchor in the mass of weight composition with the mass of weight composition substantially circumscribing at least a region of the anchor to interlock the mass of weight composition and the anchor whereby the mass of weight composition is retained in the cavity.

2. A method as defined in claim 1 wherein said anchor is deformable and said method includes deforming the anchor in the mass of weight composition.

3. A method as defined in claim 1 wherein said step of providing includes clamping the anchor in the cavity.

4. A method as defined in claim 1 wherein said step of providing includes providing the cavity with an end wall and said step of placing includes placing the mass of weight composition into engagement with the anchor prior to said step of deforming with the weight composition spaced from the end wall and then carrying out said step of deforming.

5. A method as defined in claim 1 wherein said step of providing includes providing said member as a golf club including a head and a tubular shaft, said head includes a tubular section having a passage terminating in said head and receiving an end portion of the tubular shaft, and said cavity is in said passage of said tubular section.

6. A method as defined in claim 5 wherein said anchor is deformable and said method includes deforming the anchor in the mass of weight composition.

7. A method as defined in claim 5 wherein said step of providing includes clamping the anchor between the head and the tubular shaft with the anchor projecting into the passage from the region where it is clamped.

8. A method as defined in claim 5 wherein said golf club defines an end wall for the cavity and said step of deforming includes inserting a ram into the tubular shaft and compressively loading the weight composition by forcing the mass of weight composition toward the end wall with the ram.

9. A method as defined in claim 8 including deforming the anchor with the ram during the deforming of the mass weight composition.

10. A weighted article comprising:

a member having a cavity therein;

an anchor affixed to said member and extending within the cavity at least part way across the cavity;

a mass of permanently deformable weight composition in the cavity;

at least a portion of the anchor being substantially embedded in the mass of weight composition; and the mass of weight composition substantially circumscribing at least a region of the anchor to interlock the mass of weight composition and the anchor to thereby at least assist in retaining the weight composition in the cavity.

11. A weighted article as defined in claim 10 wherein said mass of weight composition includes particulate metal and a binder for holding a particulate metal together.

12. A weighted article as defined in claim 10 wherein said anchor is constructed of deformable material, and at least a region of said anchor is deformed in said cavity.

13. A weighted article as defined in claim 10 wherein the anchor extends across the cavity from one location on the periphery of the cavity to another location on the periphery of the cavity.

14. A weighted article as defined in claim 10 wherein the cavity has an end wall and the anchor extends from a location near the end wall generally away from the end wall.

15. A weighted article as defined in claim 10 wherein said member includes means for clamping the anchor in the cavity.

16. A weighted article as defined in claim 10 wherein said anchor includes a relatively flat band extending within and at least partially across the cavity.

17. A weighted article as defined in claim 10 wherein said member comprises a golf club including a head and a tubular shaft, said head includes a tubular section having a passage terminating in said head and receiving an end portion of the tubular shaft, and said cavity is in said passage of said tubular section.

18. A weighted article as defined in claim 17 wherein said anchor includes a flange and said flange is clamped between the head and the tubular shaft and the anchor projects into the tubular section.

19. A weighted article as defined in claim 17 wherein said anchor includes spaced flange sections and a generally flat band extending between said flange sections, said flange section being at least partially received between the head and the tubular shaft and said band projects generally across the passage.

20. A weighted article as defined in claim 17 wherein said anchor includes a relatively flat band extending at least partly across said passage of said tubular section and said band is embedded in said mass of weight composition.

* * * * *